United States Patent [19]

Helpinstill, III

[11] 4,254,684

[45] Mar. 10, 1981

[54] BREAKDOWN PIANO

[76] Inventor: Charles T. Helpinstill, III, 5808 S. Rice Ave., Houston, Tex. 77081

[21] Appl. No.: 6,802

[22] Filed: Jan. 25, 1979

[51] Int. Cl.[3] ..... G10C 1/00; G10C 3/02

[52] U.S. Cl. ..... 84/176

[58] Field of Search ..... 84/174, 176

[56] References Cited

U.S. PATENT DOCUMENTS

| | | | |
|---|---|---|---|
| 3,285,116 | 11/1966 | Rhodes | 84/176 |
| 3,426,636 | 2/1969 | Starck et al. | 84/176 |
| 4,130,044 | 12/1978 | Yamada et al. | 84/176 |

FOREIGN PATENT DOCUMENTS

| | | | |
|---|---|---|---|
| 240055 | 9/1925 | United Kingdom | 84/176 |

*Primary Examiner*—Lawrence R. Franklin
*Attorney, Agent, or Firm*—Gunn, Lee & Jackson

[57] ABSTRACT

A breakdown piano is disclosed which incorporates, in the preferred and illustrated embodiment, a separable keyboard with hammer mechanism attached which slidably removes from the body of the piano. The remainder of the piano apparatus is incorporated with the body. This is an aid to reduction of weight and division of the piano into two more readily manageable packages for quick moves. The apparatus incorporates a slide assembly aligning the keyboard, a clamp to latch the hammers in a fixed position when detached from the body and a latch release mechanism. There is, additionally, means for bolting the piano keyboard to the body.

9 Claims, 6 Drawing Figures

FIG. 1
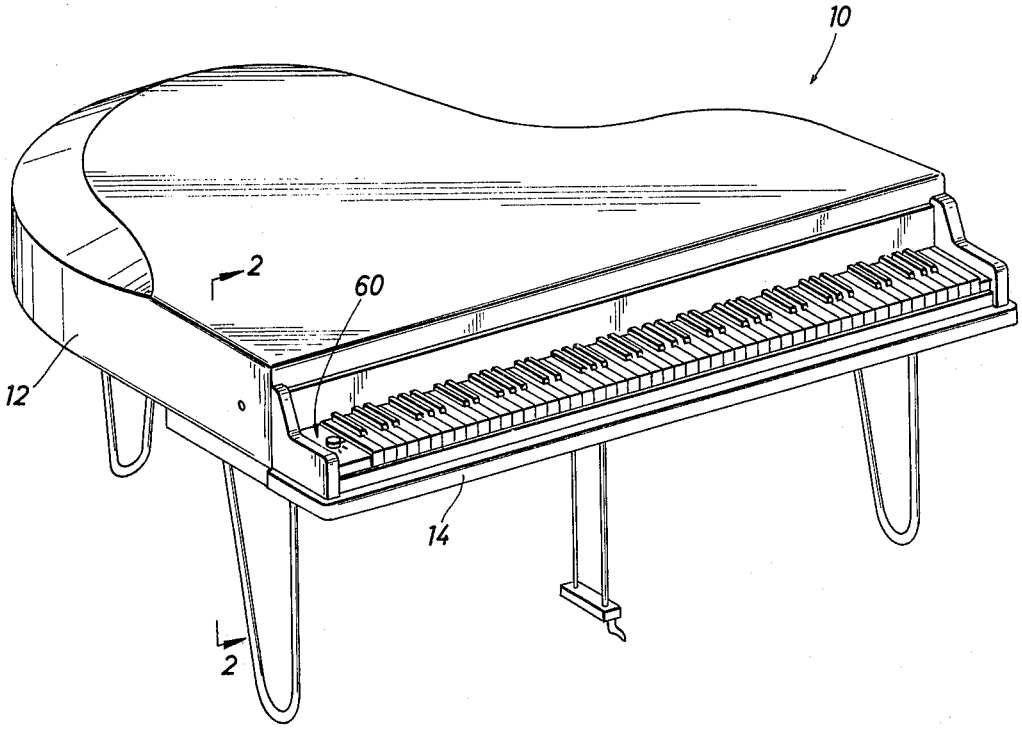
FIG. 2
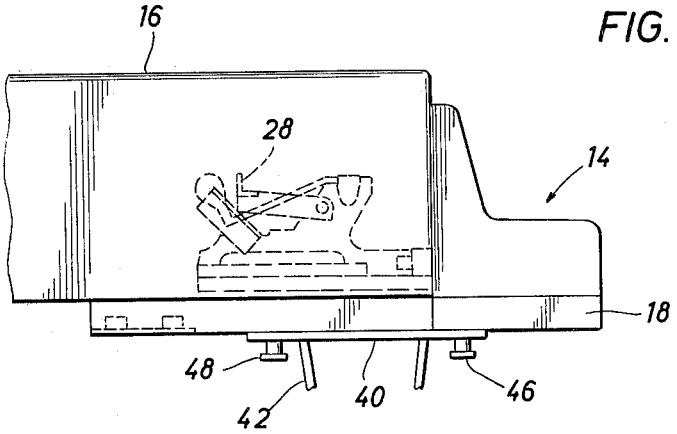
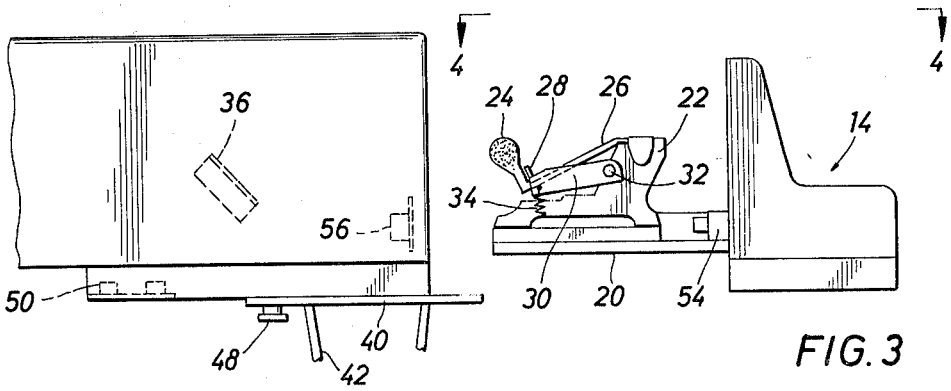
FIG. 3

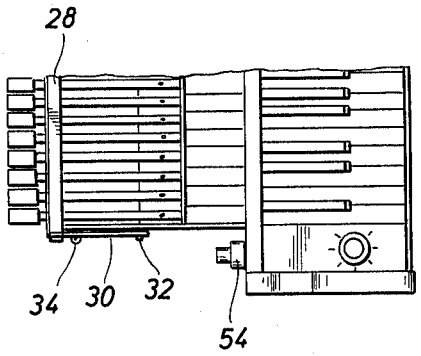
FIG. 4
FIG. 5
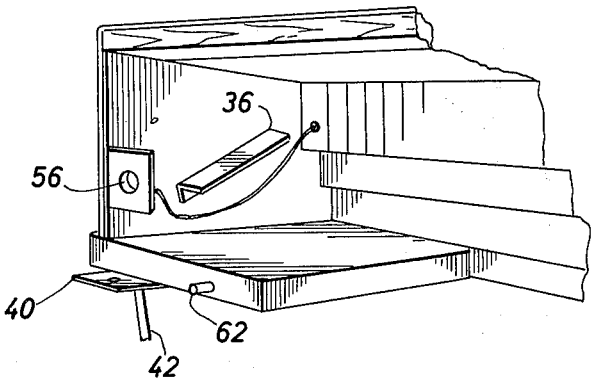
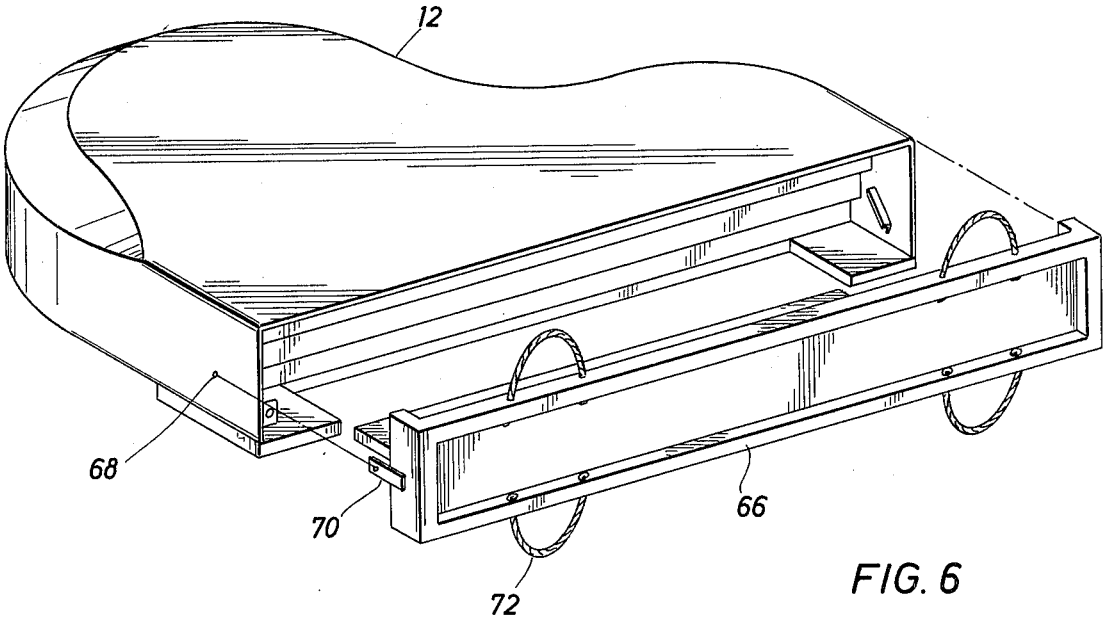
FIG. 6

BREAKDOWN PIANO

BACKGROUND OF THE DISCLOSURE

A piano is a very popular instrument with small instrumental groups. It is a device which has substantial bulk and weight as a result of its size. With small traveling musical entertainment groups, the piano must, nevertheless, be moved from engagement to engagement. This is difficult to accomplish as a result of the size, weight and bulk of a piano. In particular, the weight is such, when coupled with its shape, the apparatus is very difficult to handle by even strong workers. This is true both of standard percussion piano instruments and electronic keyboard instruments.

The piano has a specified length at the keyboard, but, other than this, the shape and profile of a piano may vary. They commonly fall into two categories, the upright or grand piano type constructions. The present invention is an apparatus which particularly enables the grand piano type construction to be utilized, although it is also adapted for incorporation in an upright piano construction. Through the use of the present invention, a single piano, perhaps weighing 300 to 400 pounds, is divided into two packages. One package will incorporate the bulk of the body, but is reduced notably in weight. The precise change in weight depends on the particular construction of piano involved, particularly whether it has heavy wooden frame members or a cast iron frame. Without regard to the details of its construction, the piano body, itself, is markedly lighter as a result of removal of the keyboard and all of the apparatus affixed to the back side of the keyboard.

The present invention thus divides the piano into two separate packages. It particularly protects the rather delicate construction found in the keyboard area. The keyboard, itself, is connected by suitable levers to a piano striker mechanism. The striker mechanism includes pivoted hammers which are padded around the head of the hammer with a felt covering. The keyboard, when removed, incorporates apparatus which clamps the hammers against loose movement, thereby protecting the nest of hammers. Presumably, eighty-eight hammers are ordinarily included inasmuch as this is the customary configuration of a piano.

The present apparatus divides a piano for quick assembly or knockdown. It yields two separate assemblies which can travel quite easily. Moreover, it yields a body of reduced weight which can be more readily handled by two workmen. By contrast, two workmen can hardly handle a fully assembled, complete piano with all components. The keyboard assembly, when removed, is able to be handled quite easily. Indeed, it can be removed and set in a generally rectangular storage box or cabinet for protection. At the time of disassembly or reassembly, the equipment goes together quite readily.

BRIEF DESCRIPTION OF THE DRAWINGS

FIG. 1 is a perspective view of a piano from an elevated point of view showing the modified piano of the present invention in the form of a grand piano;

FIG. 2 is an end view of the keyboard showing a removable keyboard assembly slidably received in a piano body;

FIG. 3 is a view similar to FIG. 2 showing the keyboard assembly moved away from the piano body;

FIG. 4 is a view from above of the separable keyboard unit shown in FIG. 3 showing details of construction and, in particular, an aligned plug and socket;

FIG. 5 is a view of the interior corner construction of the piano body where the keyboard unit is received; and FIG. 6 shows a corner to be placed over the piano body after removal of the keyboard assembly to provide readily available handles for moving the piano body.

DETAILED DESCRIPTION OF THE PREFERRED EMBODIMENT

Attention is first directed to FIG. 1 of the drawings where the numeral 10 identifies a piano constructed and arranged in accordance with the teachings of the present invention. The piano 10 is a conventional piano in many regards. That is to say, it incorporates a conventional 88-note keyboard of standard dimensions and standard note arrangement. It is a conventional piano in the sense that it utilizes a percussive hammer arrangement positioned adjacent a set of strings to form the 88 notes. The body is shaped in the form of a grand piano. Ideally, the grand piano construction of FIG. 1 can incorporate either a raisable lid or, in the alternative, a closed, fitted, plastic housing having the shape of a grand piano. Moreover, the description which will follow presumes that the apparatus is an electronic piano which is a piano which includes the typical hammer and string arrangement but which also includes electromagnetically coupled pickups for forming signals to be conveyed elsewhere for amplification. The exemplary piano of FIG. 1 has thus been modified to accommodate the present invention which enables it to be assembled and disassembled for ease of transportation. To this end, the numeral 12 identifies the piano body, proper, while the numeral 14 identifies a slidably removable keyboard assembly.

Attention is next directed to FIGS. 2 and 3 of the drawings, which will be considered jointly. There, the piano body incorporates a housing 16 which is shaped and contoured in some suitable form, and the illustrated embodiment is the body of a grand piano. The grand piano body is open across the width of the front to receive the keyboard unit 14. The keyboard unit, itself, incorporates a bottom base frame member 18 which supports a second horizontal frame member 20 shown in FIG. 3. The frame member 20, in turn, supports a hammer assembly at 22. The hammer assembly 22 swings a hammer 24. At this juncture, it will be noted that hammer assemblies are positioned where the hammer faces upwardly and swings upwardly as shown in these drawings. In the alternative, the hammer is pivoted in the same fashion, but stands somewhat erect and swings in a counterclockwise pivotal direction. The precise beginning point of the hammer and the direction in which it rotates depends on the position of the strings relative to the hammer. In the embodiment disclosed herein, the strings extend generally horizontally and are struck from the bottom side. It is also possible for the strings to be arranged vertically and to be struck by a hammer which stands generally erect and swings by rotating in a counterclockwise direction through an upright position toward the strings. These are design variations which can be accommodated in various pianos. However, the preferred embodiment of the present invention is that which is illustrated where the hammer 24 swings upwardly to strike the target string from the lower side.

The apparatus shown in FIG. 3 further includes 88 duplicate sets of equipment, that is, keys and suitable key couplings to the individual hammers. The hammers are aligned across the width of the apparatus, thus extending into the plane of FIG. 3. The plurality of hammers incorporates a fixed end member as shown in FIG. 3. There is a similar fixed end member at the opposite end. The hammer 24 is rotated on an arm 26 which extends from a pivot point to the hammer, proper. The hammer 24 and the arm 26 which is appended to it are clamped in position by a lock bar 28 which extends over all 88 keys of the keyboard, itself. The lock bar 28 is affixed at each end to a pivoted arm 30 which, in turn, is anchored at a pivot having the form of an anchor bolt 32. Duplicate equipment, of course, is included at both ends. The lock bar 28 is adapted to rotate in a clockwise direction, as viewed in FIG. 3. It is shown in the "up" position in FIG. 2. It is in the "down" or locking position in FIG. 3. The lock bar 28 serves as a clamp or lock for the entire nest of hammers, securing all of them in the "down" position against movement, as shown in FIG. 3. This is accomplished by rotating the mounting arm 30 from the "down" position of FIG. 3 to the "up" position of FIG. 2.

The arm 30 in FIG. 3 is pulled downwardly by a return spring 34 which is attached to the arm 30 and tied below to a fixed part of the framework 20. This pulls the arm down and, in turn, pulls the lock member 28, coupled with gravity pull, toward the hammers to hold them in a locked position.

In FIG. 2 of the drawings, it will be noted that the lock member 28 has been raised. A deflector bar 36 formed of angle stock is located on the inside vertical wall of the cabinet or housing. The angle stock is also shown in FIG. 5 of the drawings. The angle stock material is incorporated to serve as a guide to guide the clamp mechanism up and away from the hammers and support arms for the hammers. As the apparatus is inserted as shown in FIG. 3, the arm 30 is caught by the protruding angle bar 36 and is rotated upwardly. This movement is accomplished on insertion to withdraw the lock member 28 to permit the keyboard instrument to play.

It will be observed that the extent of rotation of the lock bar 28 is sufficient to enable the hammers to rotate through the full range of movement from the "down"or rest position, shown in FIGS. 2 and 3, upwardly to strike against the overhead strings. The range of travel is measured in just a few millimeters.

The apparatus of the present invention is assembled in FIGS. 2 and 3 in the following manner. The body 12 is supported on a leg which has a horizontal top plate 40 which is positioned against the lower side of the piano housing or cabinet. It is affixed to a pair of angled, vertical legs 42 which extend to the floor to hold the piano at the requisite height. A first hand-rotatable bolt 46 passes through the top plate 40, and a back bolt 48 is also used. Briefly, the bolt 46 passes through the plate 40 and into a threaded or tapped opening in the frame member 18. This securely fastens the removable keyboard portion 14 to the plate 40. In addition, the bolt 48 passes through the plate 40 and fastens into the framework of the piano body 12. The two bolts 46 and 48 thus secure the two major components together, utilizing the top plate 40 of the leg as a strap to fixedly join the two major assemblies together. Because this equipment is duplicated at both ends, relatively easy alignment and parallel positioning is achieved. In like fashion, the bolts are stored by fastening them in tapped openings 50, while the legs are removed from the apparatus during transportation.

The present invention can be used with a piano which incorporates electronic pickups. To this end, the numeral 54 identifies a plug on the keyboard assembly in FIG. 3, while the numeral 56 identifies an aligned socket on the inside of the case or cabinet. The socket 56 is more fully shown in FIG. 5, where the socket 56 provides suitable connection with electromagnetic pickups in the rear of the equipment near the strings and further permits the signal from them to be carried toward the front of the cabinet to an exposed location at the lefthand end of the keyboard. A control for operation of an electric keyboard is shown in FIG. 1 and is identified by the numeral 60.

FIG. 5 of the drawings discloses an alignment pin 62. One or more such alignment pins pointed forwardly from the lower horizontal framework of the piano body 12 can be incorporated. They assist the apparatus at the time of assembly whereby the removable and detachable keyboard assembly slides smoothly in a guided manner determined by the alignment pin 62.

Attention is next directed to FIG. 6 of the drawings, where only the piano body 12 is shown. A closure plate 66 is positioned over the opening which is vacated on removal of the keyboard assembly. The numeral 68 identifies a bolt hole at one end, and a similar bolt hole is included at the other end of the equipment. The plate or cover 66 is a stout framework sized to close the opening which is left upon removal of the keyboard assembly. It carries a protruding tab 70 which is positioned over the opening 68 so that a bolt can be positioned to join the two members. Two or more such bolts are used to join the cover plate 66. The cover plate, itself, is a stout, heavy framework of sufficient strength to be held by rope handles 72. Suitable handles are positioned on it, preferably at the two ends. In the illustrated embodiment, four such rope handles are found, and they enable the apparatus to be lifted after the cover plate 66 has been fastened to the body 12. This is an arrangement whereby the body 12 can be picked up by workmen and moved. Other types of handles can be affixed. The handles are exposed for easy grasping of the cover plate 66.

In operation, the device of the present invention is assembled in the following manner. The legs are positioned beneath the piano body 12 and partly attached. This is achieved as shown in FIG. 3 of the drawings wherein the top plate of the leg assembly is first fastened with the bolt 48. The keyboard unit 14, itself, is then smoothly aligned with the opening in the piano body 12 and is inserted into it smoothly. As it slides into the piano body, the lock member 28 is lifted by means of the angularly positioned deflector plates 36 at each end. This unlocks the hammers of the keyboard. Moreover, unlocking of the keyboard frees the apparatus to function as a conventional piano. Installation is then completed by affixing the bolt 46 to fasten the keyboard assembly 14 firmly in place. By the movement described above, the plug 54 is fastened with the socket 56 to thereby make that connection complete. At this point in time, the apparatus is then ready to use. Disassembly is accomplished by reversing the assembly steps described above.

Disassembly of the present invention is particularly noteworthy in that it divides the very heavy equipment into smaller units which can be handled more easily. Moreover, the piano body 12 is easily handled when the handles shown in FIG. 6 are attached to enable workmen to lift the piano body 12. The keyboard assembly 14 is preferably stored in a rectangular container cabinet or suitcase. Ideally, it is sized to receive the keyboard rather precisely, and foam rubber, felt lining or other packing material is used to protect it against jarring, scratching or unintended impact.

The present invention enables the keyboard assembly to be separated, and, yet, the critical alignment and sensitivity adjustments of the keyboard hammer mechanism are protected. This has the advantage of keeping the equipment aligned and correctly adjusted for easy subsequent installation without retuning or adjustment.

The foregoing is directed to the preferred embodiment, but the scope of the present invention is determined by the claims which follow.

I claim:

1. In a piano which includes a piano body having a framework and strings therein as a first assembly, and which further includes a separable keyboard assembly which includes the keys and actuators causing hammers to strike the strings to form a musical note, the improvement which comprises:

(a) a means for aligning the keyboard assembly for removal and installation relative to the piano body;

(b) means for fixedly attaching the keyboard assembly to the piano body at an operative position such that striking a key of the keyboard assembly causes a hammer to strike an associated string in the piano body to form a musical note;

(c) lock means pivotally fixed to the keyboard assembly for securing the hammers against movement on removal of the keyboard assembly from the piano body;

(d) deflector means for engaging said pivotal lock means for releasing the hammers upon installation of the keyboard assembly in the piano body; and (e) wherein said attaching means selectively connects and disconnects the keyboard assembly to the piano body.

2. The apparatus of claim 1 wherein said piano keyboard assembly incorporates said lock means extending thereacross to lock the key operated means for actuating hammer movement and wherein said lock means comprises a lock bar extending adjacent the hammers and further including means for pivotally removing said lock bar from a hammer locking position to a position which leaves the hammers free to function such that striking a key causes a hammer to strike a string within the piano body.

3. The apparatus of claim 2 wherein said deflector means includes spaced, angularly directed deflector bars fixed to said piano body for engaging said lock bar and deflecting it to a position which is away from the locked position and which holds said lock bar at the position so achieved after installation of the keyboard assembly in the piano body but which releases said lock bar to return to the locking position on removal of the keyboard assembly from said piano body.

4. The apparatus of claim 3 wherein said piano keyboard assembly and said piano body are joined together by means of a nether-positioned, connective, structural member which is attached by releasable means to the keyboard assembly and the piano body.

5. The apparatus of claim 1 including mating electrical plug and socket means supported on the keyboard assembly and the piano body.

6. The apparatus of claim 5 including a mounting means securing said mating plug and socket means recessed within the piano body which is shaped as a grand piano and including a removable cover means sized to fit over an opening formed in the piano body on removal of the keyboard assembly and further including releasable fastening means for fastening said cover means over the opening in the piano body.

7. The apparatus of claim 1 wherein said aligning means comprises a supportive framework extending beneath a set of exposed piano keys and further including a sized and shaped surrounding structure defining a receptacle within the piano body for operatively receiving the keyboard assembly.

8. The apparatus of claim 7 wherein said attaching means comprises an elongate strap means spanning the nether portions of the keyboard assembly and the piano body and further including removable fasteners for attaching said strap means to the keyboard assembly and piano body.

9. The apparatus of claim 8 wherein said strap means is a portion of a piano leg, and the piano body is shaped as a grand piano.

* * * * *